US007389065B2

(12) United States Patent
Kasama

(10) Patent No.: US 7,389,065 B2
(45) Date of Patent: Jun. 17, 2008

(54) IMAGE-FORMING APPARATUS WITH VIBRATING PART

(75) Inventor: Minoru Kasama, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 223 days.

(21) Appl. No.: 11/318,625

(22) Filed: Dec. 28, 2005

(65) Prior Publication Data

US 2007/0059019 A1 Mar. 15, 2007

(30) Foreign Application Priority Data

Sep. 14, 2005 (JP) ..... 2005-267072

(51) Int. Cl.
*G03G 21/20* (2006.01)
*G03G 15/20* (2006.01)

(52) U.S. Cl. ..... 399/91; 399/97; 399/320

(58) Field of Classification Search ..... 399/91, 399/320, 97

See application file for complete search history.

(56) References Cited

U.S. PATENT DOCUMENTS 5,339,147 A * 8/1994 Snelling et al.
6,947,697 B2 * 9/2005 Fujimoto et al. ..... 399/320

FOREIGN PATENT DOCUMENTS

| | | | |
|---|---|---|---|
| JP | 54097046 A | * | 7/1979 |
| JP | A-1-251072 | | 10/1989 |
| JP | A-4-151679 | | 5/1992 |
| JP | 04195179 A | * | 7/1992 |
| JP | A-7-160179 | | 6/1995 |
| JP | A-9-090855 | | 4/1997 |
| JP | A-2001-175153 | | 6/2001 |
| JP | 2002162846 A | * | 6/2002 |
| JP | 2003162161 A | * | 6/2003 |
| JP | 2005049462 A | * | 2/2005 |

* cited by examiner

*Primary Examiner*—Susan S Lee
(74) *Attorney, Agent, or Firm*—Morgan, Lewis & Bockius LLP

(57) ABSTRACT

An image-forming apparatus includes a transfer part that transfers a toner image to a sheet; a fixing part that heats a sheet to which a toner image is transferred by the transfer part to a temperature at which the toner on the sheet melts, and ejects the sheet; a vibrating part that vibrates a member positioned near and/or above the fixing part at a frequency higher than audible frequencies.

7 Claims, 4 Drawing Sheets

IMAGE-FORMING APPARATUS WITH VIBRATING PART

BACKGROUND OF THE INVENTION

1. Field of the invention

This invention relates to an image-forming apparatus such as an electrophotographic copier or printer, and particularly to technology for suppressing noise production while efficiently expelling water vapor emitted from a fixer to outside the machine.

2. Description of the Related Art

An example of an electrophotographic image-forming apparatus of related art is shown in FIG. 5. And, the vicinity of a fixer of this image-forming apparatus 900 is shown in FIG. 6. The image-forming apparatus 900 has a laser reading device 1 for directing a laser beam corresponding to an image signal at a photosensitive drum 2 and forming an electrostatic latent image corresponding to the image signal on the photosensitive drum 2, which is charged by a charger 3; a developing roller 4 for developing the electrostatic latent image; paper feed rollers 5 and 6 for feeding paper from a cassette tray 7 to the photosensitive drum 2; a transfer roller 8 for transferring a toner image developed on the surface of the photosensitive drum 2 to a sheet of paper by means of electrostatic force accompanying electric discharge; and a fixer 14 for fixing the image to the paper by applying pressure and heat with a pair of fixing rollers 12.

As shown in FIG. 6, paper ejected upward from the fixer 14 is guided to ejecting rollers 24 by paper guides 16 and a paper feed chute 20 and is ejected through a paper delivery opening 18 into a tray 22 formed in an upper face of a housing member 10. Because in the fixer 14 moisture contained in the paper with the toner image formed upon it is heated and becomes water vapor, air vents 26 for venting heat and water vapor from the fixer 14 are provided in the upper cover 10*a* around the fixer 14. Ribs 11 are provided pointing downward in positions adjacent to the air vents 26 on the rear side of the housing member 10.

As can be seen from FIG. 6, the route from the fixing rollers 12 to the ejecting rollers 24 is a section where the paper feed direction changes greatly over a short distance. Consequently, in this location, scraping noises caused by friction between the paper and the paper guides 16 or the paper feed chute 20 arise. Also, in this location, it sometimes happens that vibration of gears driving the fixer 14 and the ejecting rollers 24 is transmitted to the paper and gives rise to further noise. To avoid these noises leaking to outside the machine, the area of the air vents 26 around the fixer 14 is kept to within a certain range. And because of this, water vapor emitted from the fixer 14 is not rapidly vented through the air vents 26 and tends to stagnate. Consequently, the possibility has arisen of some of the water vapor condensing on the housing member 10 around the fixer 14 and eventually dripping onto the paper as it is transported. As a result, problems such as paper jamming and paper soiling and crinkling have arisen.

SUMMARY OF THE INVENTION

The present invention has been made in view of the above circumstances and provides an image-forming apparatus.

An image-forming apparatus according to an aspect of the invention includes a transfer part that transfers a toner image to a sheet, a fixing part that heats a sheet to which a toner image is transferred by the transfer part to a temperature at which the toner on the sheet melts, and ejects the sheet, and a vibrating part that vibrates a member positioned near and/or above the fixing part at a frequency higher than audible frequencies.

BRIEF DESCRIPTION OF THE DRAWINGS

Embodiments of the invention will be described below in detail on the basis of the following figures, wherein.

DETAILED DESCRIPTION OF THE INVENTION

1. First Embodiment

Figure 1:
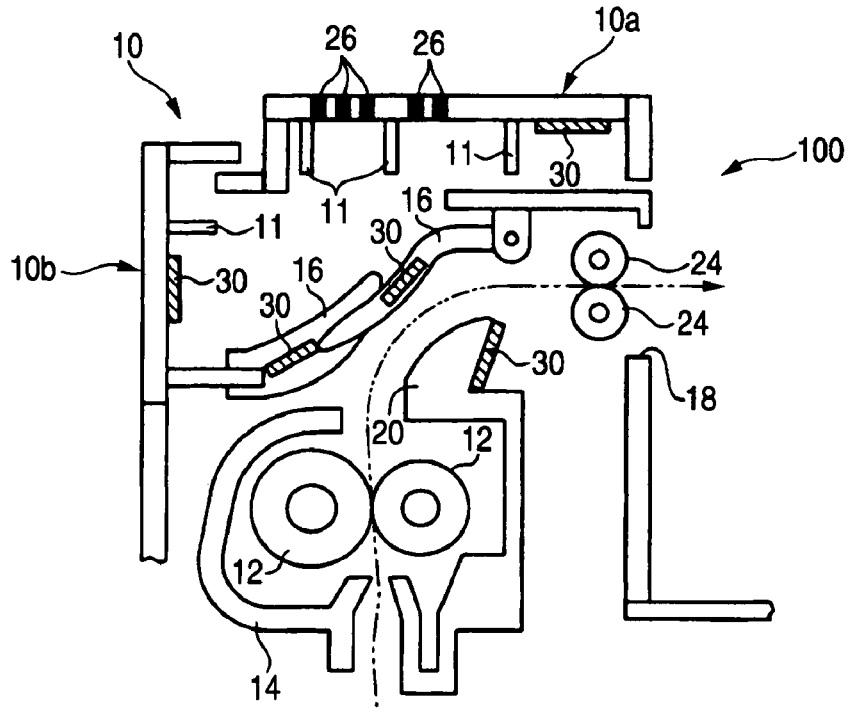
FIG. 1 is a view showing an image-forming apparatus according to a first embodiment of the invention.
Figure 5:
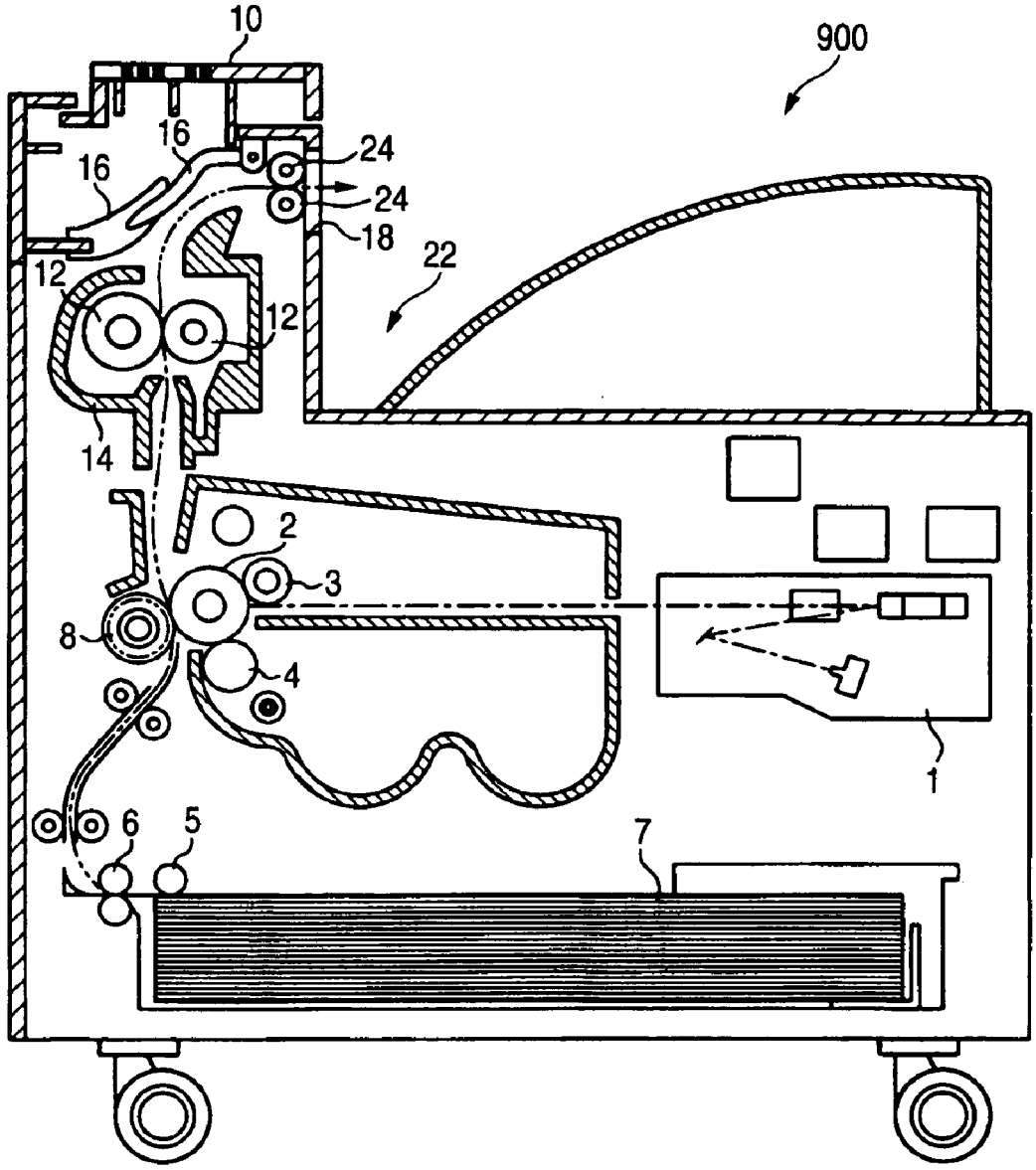
FIG. 5 RELATED ART
FIG. 5 is a view showing an example of an electrophotographic image-forming apparatus of related art.
Figure 6:
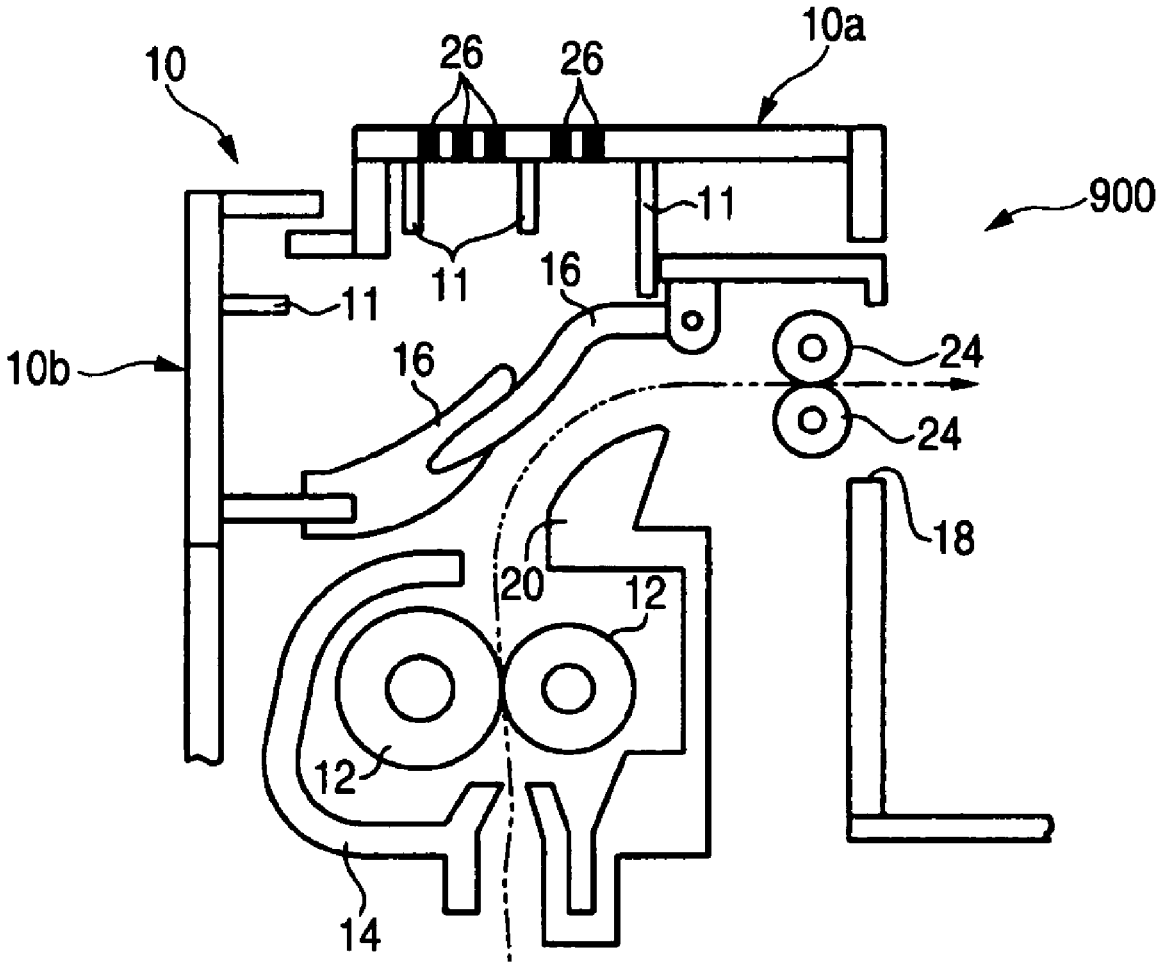
FIG. 6 RELATED ART
FIG. 6 is a view showing the vicinity of a fixer in an image-forming apparatus of related art.

FIG. 1 is a view showing a image-forming apparatus 100 according to a first embodiment of the invention. In this figure, only parts of the image-forming apparatus 100 for performing a fixing step are shown. The construction of the rest of the image-forming apparatus 100 is the same as in FIG. 5. That is, the image-forming apparatus 100 has a laser reading device 1, a photosensitive drum 2, a charger 3, a developing roller 4, paper feed rollers 5, 6, a cassette tray 7 and a transfer roller 8. These parts cooperate to transfer a toner image to a sheet-form recording material such as paper (hereinafter called 'paper').

The part shown in FIG. 1 is mounted below a box-shaped housing member 10 and has a fixer 14 having a pair of fixing rollers 12, paper guides 16 for changing the feed direction of paper being delivered upward through the fixing rollers 12 to a substantially horizontal direction, a paper feed chute 20 for guiding the paper to a paper delivery opening 18, and ejecting rollers 24 for delivering the paper through the paper delivery opening 18 onto a tray 22. The paper guides 16 are a pair of movable members projecting to above the fixer 14 from the left and right as shown in the figure and have slits formed in them so that moist air of high-temperature containing water vapor from the fixer 14 can pass through to above them. The paper feed chute 20 forms a part of a cover of the fixer 14.

Air vents 26 consisting of multiple openings are provided in an upper cover 10*a* above the fixer 14. These openings are desirebly small in diameter, to minimize the leakage of noise from within. Reinforcing ribs 11 are provided on the underside of the upper cover 10*a* in positions adjacent to the air vents 26, pointing downward.

In this embodiment, vibrators 30 for atomizing moisture having landed on the housing member 10 and the members inside it are mounted on those members (hereinafter called 'the object members'). As the vibrators 30, for example transducers that expand and contract under a piezoelectric effect (hereinafter called 'piezoelectric transducers') are used. Piezoelectric transducers have the merits that their power consumption is small, they are easy to mount because they are compact and take up little space, and since a drive mechanism is not needed they can be constructed cheaply.

By undergoing so-called ultrasonic oscillation at a frequency above frequencies audible to humans (normally above 20 kHz), the vibrators 30 cause countless cavitations in the surfaces of and within the water droplets having formed on the object members. This reduces the surface tension of the water droplets and promotes atomization.

As the object members to which the vibrators 30 are attached, members disposed along the flow path of aw air current formed on the inner side of the housing member 10 may be selected. This air current is formed by natural convection caused mainly by heat from the fixer 14, and includes a main current passing through the air vents 26 and complex branch currents formed by the shapes of the spaces on the inner side of the housing member 10. Because water vapor emitted from paper in the fixer 14 condenses readily in the branch currents, which are lower in temperature, it is necessary for members in the vicinities of the branch currents to be made object members. Generally, because the air currents are formed above the fixer 14, members on the upper side are selected, but since the air currents also swirl around, the object members are not limited to these upper members.

In this embodiment, as the object members, the paper guides 16, which are directly above the fixer 14; the paper feed chute 20, which is diagonally above it; and upper cover 10*a* and a side cover 10*b* are selected. Because the paper guides 16 and the paper feed chute 20 make direct contact with the paper, it is necessary for moisture and dirt to be prevented from adhering directly to the paper from these. And as a result of an ultrasonic oscillation being applied to these, there is also an effect of preventing paper jamming caused by the paper catching on them due to friction. At the upper cover 10*a* and the side cover 10*b*, on the other hand, because they have the ribs 11 formed on them, branch currents tend to form. By applying an ultrasonic oscillation to these, it is possible to obtain an action of preventing dewing on them and promoting atomization.

The vibrators 30 are provided with a power supply circuit for obtaining a power supply for their operation from a main power supply of the image-forming apparatus 100 and a control switch for turning them ON and OFF (not shown). For example, at times such as in summer when the amount of water vapor is large, control that operates a greater number of the vibrators 30 may be carried out. The vibrators 30 are desirably driven in cooperation with the operation of the image-forming apparatus 100. If the image-forming apparatus 100 is operated continuously, the vibrators 30 may also be driven continuously, and also for a while after operation of the image-forming apparatus 100 ends, their operation may be continued with a timer to effect the atomization of condensed moisture. Of course, alternatively they may be operated independently from the operation of the image-forming apparatus 100 with a fixed time interval, for example using a timer. Although a dedicated control switch and timer may be provided, normally a controller of the image-forming apparatus constituting the main apparatus performs this function.

In an image-forming apparatus 100 constructed like this, as the temperature of the fixer 14 increases, an upward air current caused by natural convection is formed inside the housing member 10, passing through the fixer 14 from below to the air vents 26. As shown in FIG. 1, water vapor produced in the fixer 14 is carried by this air current and some of it is expelled to outside while some of it condenses on the members around the air current. In this embodiment, because the vibrators 30 are provided on these members and the members undergo ultrasonic oscillation as necessary, the condensation itself is suppressed, the condensed water is also rapidly atomized, and atomized water vapor is carried by the air current again and expelled.

As described above, with the image-forming apparatus 100 of this embodiment, without making the opening area of the air vents 26 large or introducing a forced ventilation device such as a fan that would produce noise, water vapor produced from the fixer 14 may be expelled to outside the machine. Therefore, while maintaining low noise, it may be possible to avoid wetting and soiling of paper caused by droplets from water vapor falling, and paper jams. Also, because the image-forming apparatus 100 of this embodiment has a relatively simple construction, it may be low-cost and space-saving even while performing high-quality image formation.

2. Second Embodiment

Figure 2:
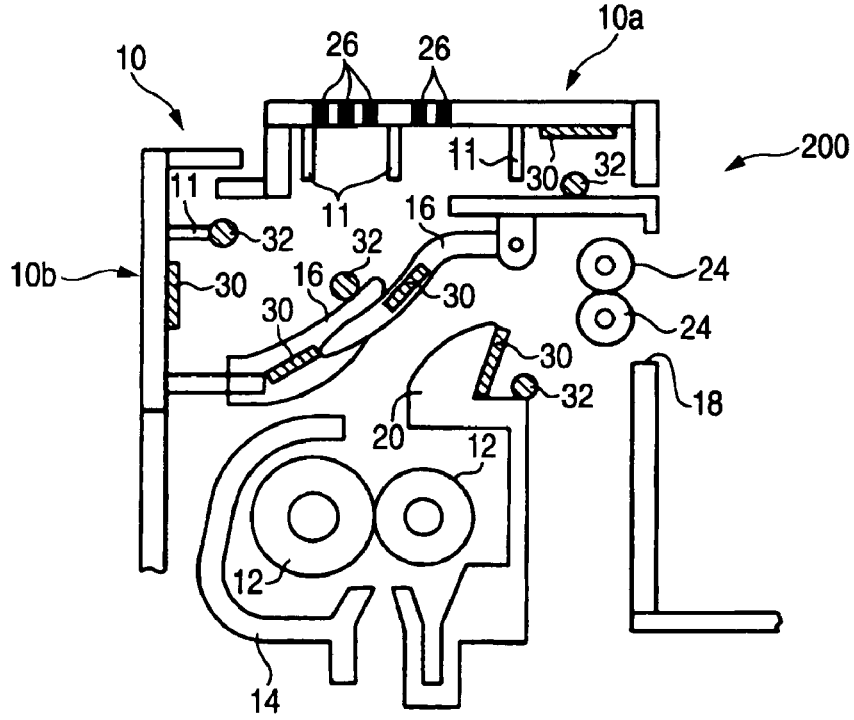
FIG. 2 is a view showing an image-forming apparatus according to a second embodiment of the invention.

FIG. 2 is a view showing a image-forming apparatus 200 according to a second embodiment of the invention. In this figure, constituent elements the same as in the first embodiment described above have been assigned the same reference numerals. These constituent elements will be omitted from the following description.

In this embodiment, humidity sensors 32 for measuring the humidities in the vicinities of the vibrators 30 are provided. The humidity sensors 32 may be provided on the object members themselves or may be provided on other parts, but a corresponding one humidity sensor 32 is provided in the vicinity of each single or group of vibrators 30. As the humidity sensors 32, from the point of view of responsiveness and measurable range, ones using macromolecular films or ones using ceramic sintered compacts are suitable.

Figure 3:
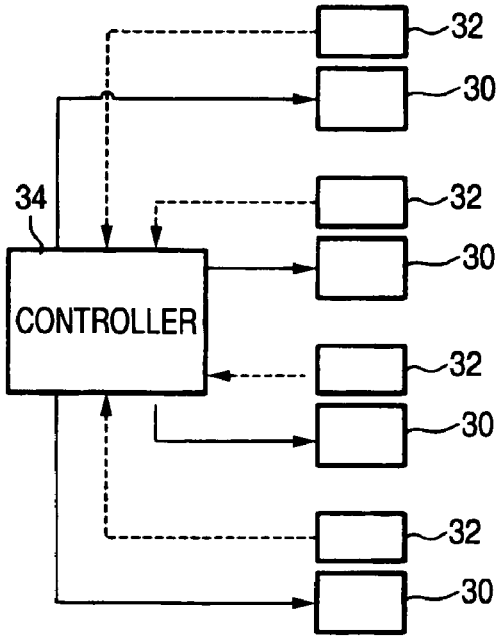
FIGS. 3A and 3B show control systems of vibrators and humidity sensors.
Figure 3:
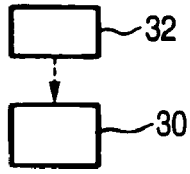

Here, a control system of the vibrators 30 and the humidity sensors 32 is shown in FIG. 3A. The outputs of the humidity sensors 32 are inputted to a controller 34 as shown in FIG. 3A, and when the humidities measured by the humidity sensor 32 have been above a preset allowable level for a predetermined time the controller 34 operates the vibrators 30. When the measured humidity is low and it is determined that the amount of water vapor being released from the paper is small, the vibrators 30 are not operated and the water vapor is dealt with by natural ventilation through the air vents 26 only. As the controller 34 a controller of the image-forming apparatus 200, which is the main apparatus, may be used, or a dedicated one may be installed. Alternatively, as shown in FIG. 3B, the individual humidity sensors may turn the vibrators 30 ON and OFF directly, without the interposition of a controller 34.

As described above, with the image-forming apparatus 200 of this embodiment, the humidities of the vicinities of the vibrators 30 can be measured directly. As a result, in addition to the same effects as those of the image-forming apparatus 100 of the first embodiment, with the image-forming apparatus 200 of this preferred embodiment it may be possible to perform fine control that takes into account environmental conditions such as temperature and humidity and usage conditions such as the frequency of operation of the apparatus.

3. Third Embodiment

Figure 4:
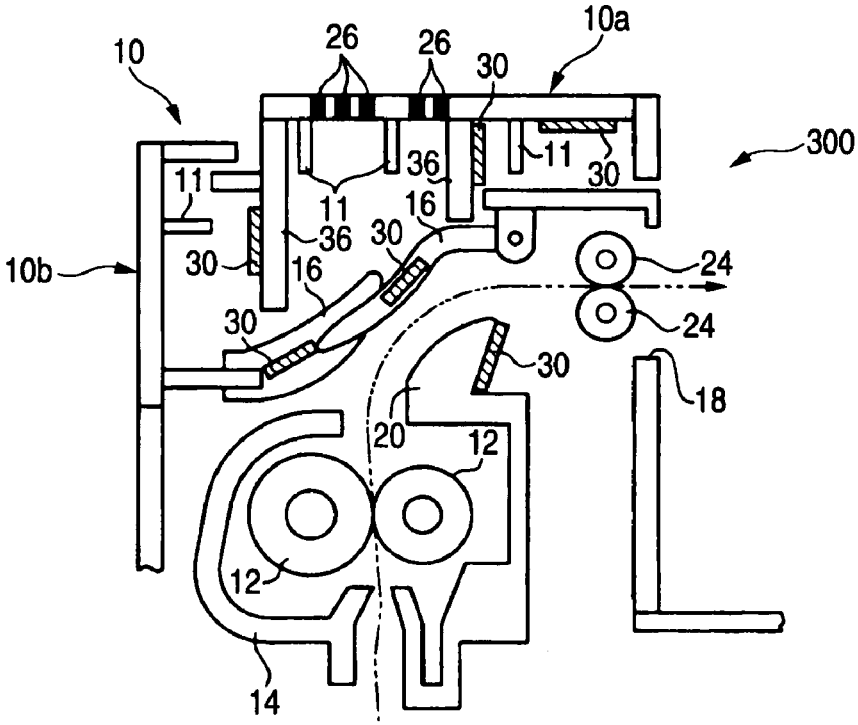
FIG. 4 is a view showing an image-forming apparatus according to a third embodiment of the invention.

FIG. 4 is a view showing an image-forming apparatus 300 according to a third embodiment of the invention. In this figure also, constituent elements the same as in the first embodiment and the second embodiment described above have been given the same reference numerals. Above the fixer 14, an airflow passage is formed by wall bodies 36 projecting downward from the upper cover 10*a*. This airflow passage forms an air current that directs water vapor released from the paper upward, and guides the water vapor to the air vents 26. The gaps between the wall bodies 36 and the other members should be made as small as possible. And, the shape of the airflow passage can be any shape such that it will guide water vapor to the air vents 26, and besides a cylindrical shape or box shape it may have the shape of a bent member, a sloping member or a conical shape whose diameter changes. Vibrators 30 the same as those on the other members are also provided in suitable locations on wall faces of the airflow passage. The construction and operation of the vibrators 30 is the same as in the first embodiment and the second embodiment.

With the image-forming apparatus 300 of this embodiment, because the formation of a rising air current is promoted by the airflow passage and the formation of branch currents is suppressed, the occurrence of condensation in corners of the housing member 10 may be suppressed. And, even when water droplets condense on the surfaces of the wall bodies 36 formed projecting inside the housing member 10, because these are atomized by the vibrators 30 and released into the air again, there may be no risk of paper being soiled by water droplets forming on the wall bodies 36.

As described above, an image-forming apparatus according to an aspect of the invention includes a transfer part that transfers a toner image to a sheet, a fixing part that heats a sheet to which a toner image is transferred by the transfer part to a temperature at which the toner melts, and ejects the sheet, and a vibrating part that vibrates a member positioned near and/or above the fixing part at a frequency higher than audible frequencies.

Here, the member near and/or above the fixing part is for example a guide member for guiding a sheet ejected from the fixing part in a certain direction, or a housing member forming a part of a housing covering the transfer part and the fixing part and defining ventilation holes for allowing air to pass between inside and outside the apparatus in the vicinity of the fixing part, or a cover member for covering the fixing part.

With this image-forming apparatus, members disposed in the vicinity of the fixing part (guide members, housing members, cover members) can be vibrated at a frequency higher than audible frequencies. As a result, the surface tension of the members may be reduced and it may be possible to suppress condensation arising on the members.

And, an image-forming apparatus according to another aspect of the invention may have a construction in which the vibrating parts are piezoelectric transducers such as piezo elements. Because the power consumption of piezoelectric transducers of this kind is generally low, even when multiple of these transducers are provided, the increase in power consumption may be kept down. And, because piezoelectric transducers of this kind are small and light and their durability is high, the increase in cost may also be kept down.

And, an image-forming apparatus according to another aspect of the invention may have a construction including a measuring part for measuring humidity in the vicinity of the vibrating part and a controller for controlling the vibrating part to vibrate the member when the humidity measured by the measuring part is higher than a certain humidity. In this case, the measuring part may be capable of measuring a humidity continuously and the controller may be constructed to operate the vibrating part when the measured humidity is higher than a certain humidity for a certain time. By means of this kind of construction it may be possible for the vibrating part to be operated only when necessary.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2005-267072 filed on Sep. 14, 2005 including specification, claims, drawings and abstract is incorporated herein by reference in its entirety.

What is claimed is:

1. An image-forming apparatus, comprising:

a transfer part that transfers a toner image to a sheet;

a fixing part that heats a sheet to which a toner image is transferred by the transfer part to a temperature at which the toner on the sheet melts, and ejects the sheet;

a vibrating part that vibrates a member positioned near and/or above the fixing part at a frequency higher than audible frequencies, wherein the member is selected from a group consisting of a guide member that guides a sheet ejected from the fixing part in a predetermined direction, a housing member that forms a part of a housing covering the transfer part and the fixing part and defines ventilation holes for allowing air to pass between inside and outside the apparatus in the vicinity of the fixing part, and a cover member covering the fixing part.

2. The image-forming apparatus according to claim 1, wherein the vibrating part is a piezoelectric transducer.

3. The image-forming apparatus according to claim 1, wherein the vibration of the vibrating part causes water vapor from the fixing part to be expelled.

4. The image-forming apparatus according to claim 1, further comprising a measuring part that measures humidity in the vicinity of the vibrating part and a controller that controls the vibrating part to vibrate the member when the humidity measured by the measuring part is higher than a predetermined humidity.

5. An image-forming apparatus, comprising:

a transfer part that transfers a toner image to a sheet;

a fixing part that heats a sheet to which a toner image is transferred by the transfer part to a temperature at which the toner on the sheet melts, and ejects the sheet;

a vibrating part that vibrates a member positioned near and/or above the fixing part at a frequency higher than audible frequencies; and a measuring part that measures humidity in the vicinity of the vibrating part and a controller that controls the vibrating part to vibrate the member when the humidity measured by the measuring part is higher than a predetermined humidity.

6. The image-forming apparatus according to claim 5, wherein the vibration of the vibrating part causes water vapor from the fixing part to be expelled.

7. The image-forming apparatus according to claim 5, wherein the vibrating part is a piezoelectric transducer.

* * * * *